US009031453B2

(12) United States Patent
Sakuma et al.

(10) Patent No.: US 9,031,453 B2
(45) Date of Patent: May 12, 2015

(54) RETAINER DEVICE AND IMAGE FORMING APPARATUS INCORPORATING SAME

(71) Applicants: Tetsushi Sakuma, Osaka (JP); Satoshi Kunioka, Hyogo (JP)

(72) Inventors: Tetsushi Sakuma, Osaka (JP); Satoshi Kunioka, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/924,923

(22) Filed: Jun. 24, 2013

(65) Prior Publication Data

US 2014/0010575 A1 Jan. 9, 2014

(30) Foreign Application Priority Data

Jul. 5, 2012 (JP) ..... 2012-151368
Jan. 29, 2013 (JP) ..... 2013-014216

(51) Int. Cl.
*G03G 15/00* (2006.01)
*G03G 21/16* (2006.01)

(52) U.S. Cl.
CPC ..... *G03G 21/168* (2013.01); *G03G 21/1647* (2013.01)

(58) Field of Classification Search
CPC ..... G03G 21/168
USPC ..... 399/121, 110
See application file for complete search history.

(56) References Cited

U.S. PATENT DOCUMENTS

2008/0028967 A1 2/2008 Sakashita et al.
2008/0138111 A1* 6/2008 Ju et al. ..... 399/121
2009/0041525 A1 2/2009 Kunioka
2010/0124028 A1 5/2010 Ogata
2012/0237268 A1 9/2012 Sakashita et al.
2013/0011158 A1 1/2013 Meguro et al.
2013/0051854 A1 2/2013 Sakuma et al.

FOREIGN PATENT DOCUMENTS

JP 62290639 A * 12/1987
JP 2006-259044 9/2006
JP 2007-333817 12/2007

(Continued)

OTHER PUBLICATIONS

Ito Yoshihiro Electrophotographic Image Forming Apparatus and Process Cartridge Jun. 30, 2000 JP2000181325.*

(Continued)

*Primary Examiner* — G. M. Hyder
(74) *Attorney, Agent, or Firm* — Oblon, McClelland, Maier & Neustadt, L.L.P.

(57) ABSTRACT

The present invention provides a retainer device capable of preventing a unit such as a transfer device from dropping when detached from an image forming apparatus. The retainer device includes a transfer device detachably attached to the image forming apparatus; a guide member to supportably guide the transfer device with respect to the image forming apparatus when the transfer device is detached from the image forming apparatus; and a stopper, disposed on the guide member, configured to contact the transfer device when the transfer device is moving in a direction separating from the image forming apparatus and stop the transfer device from dropping from the image forming apparatus. The guide member is switchable between a separation regulating state and a guidable state so that the transfer device is prevented from dropping when detached from the image forming apparatus.

19 Claims, 15 Drawing Sheets

(56) References Cited

FOREIGN PATENT DOCUMENTS

| | | |
|---|---|---|
| JP | 2008-009387 | 1/2008 |
| JP | 2009-265353 | 11/2009 |
| JP | 2010-122294 | 6/2010 |
| JP | 2010-231114 | 10/2010 |
| JP | 2010-260260 | 11/2010 |
| JP | 2010-260261 | 11/2010 |

OTHER PUBLICATIONS

Kimura Kiyoshi Image Forming Device Mar. 26, 1996 JP08083037.*

* cited by examiner

RETAINER DEVICE AND IMAGE FORMING APPARATUS INCORPORATING SAME

CROSS-REFERENCE TO RELATED APPLICATION

The present application claims priority pursuant to 35 U.S.C. §119 from Japanese patent application numbers 2012-151368 and 2013-014216, filed on Jul. 5, 2012 and Jan. 29, 2013, respectively, the entire disclosures of which are incorporated by reference herein.

BACKGROUND

1. Technical Field

The present invention relates to a retainer device to prevent a unit such as a transfer device from dropping from a body of an image forming apparatus, and to an image forming apparatus including the retainer device.

2. Related Art

In general, a transfer device disposed in an image forming apparatus has a lifetime shorter than that of the image forming apparatus, and therefore, the transfer device needs to be replaced several times during the lifetime of the apparatus. Accordingly, the transfer device is designed to be removable from the apparatus.

JP-2000-235309-A and JP-2006-259044-A, for example, disclose an image forming apparatus in which the transfer device is removed from an opening when a cover on the apparatus is opened. The image forming apparatus includes a guide rail for use in the replacement of the transfer device.

Providing the guide rail in the apparatus facilitates attachment and removal of the transfer device. However, if the transfer device comes off the rail in replacement of the transfer device before the transfer device is lifted up, the transfer device might be dropped.

To solve the above problem, the image forming apparatus disclosed in JP-2007-333817-A includes a transfer device provided with a foot member. Thus, even though the transfer device falls during removal, the foot member prevents direct contact of the transfer device with the floor.

However, that the foot member is added to the transfer device increases the overall size of the apparatus.

SUMMARY

The present invention provides a retainer device capable of preventing a unit such as a transfer device from dropping when detached from an image forming apparatus and including: a transfer device detachably attached to the image forming apparatus; a guide member to supportably guide the transfer device with respect to the image forming apparatus when the transfer device is detached from the image forming apparatus; and a stopper, disposed on the guide member, configured to contact the transfer device when the transfer device is moving in a direction separating from the image forming apparatus and stop the transfer device from dropping the image forming apparatus.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described referring to the accompanying drawings. In each of the following drawings, parts or components having the same function or shape are given the same reference, and once explained, a redundant description thereof will be omitted.

Figure 1:
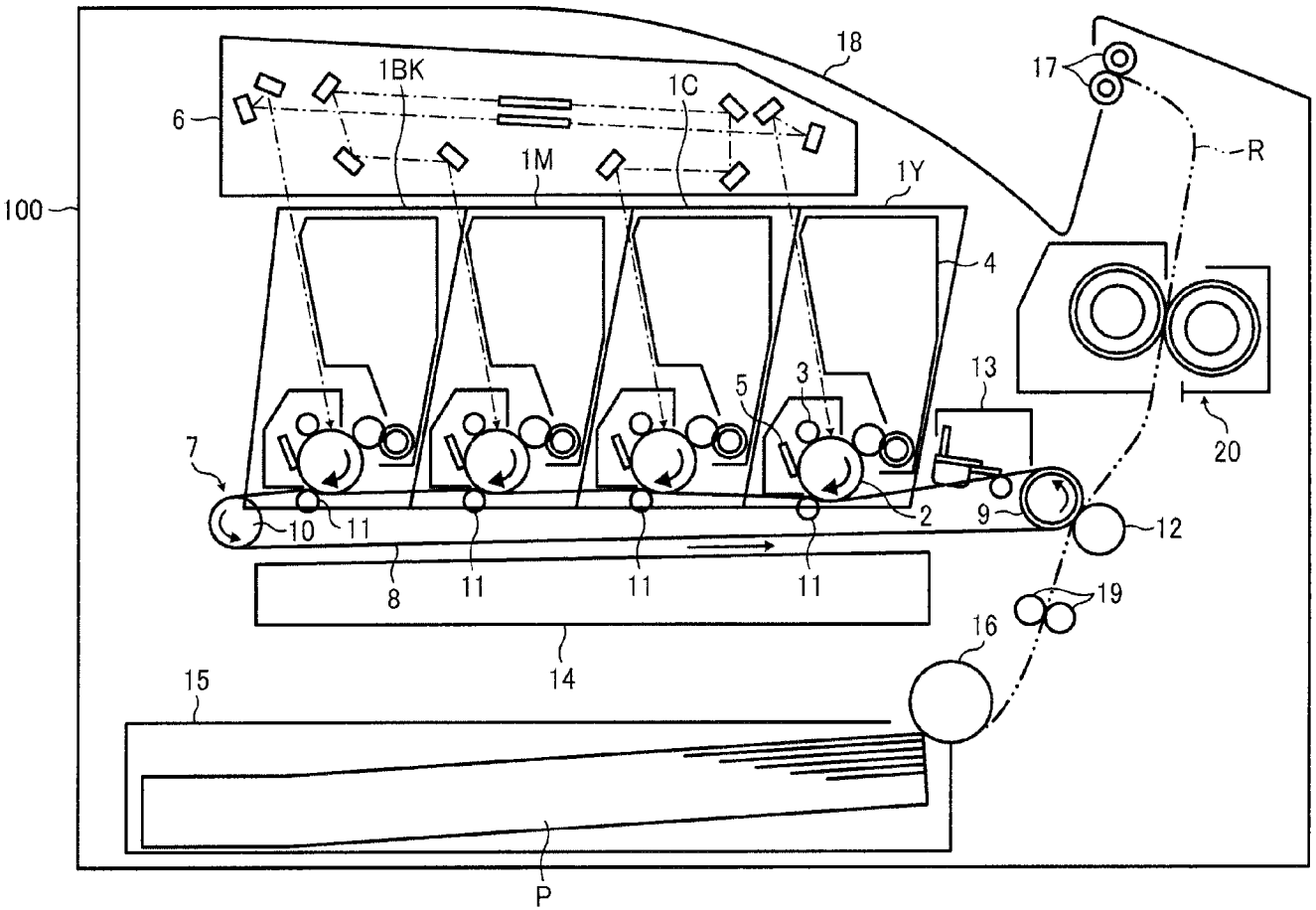
FIG. 1 shows a schematic configuration of a color laser printer as an image forming apparatus according to an embodiment of the present invention.

FIG. 1 shows an overall configuration of a color laser printer as an image forming apparatus according to an embodiment of the present invention. First, with reference to FIG. 1, the structure and operation of a color laser printer will be described.

As illustrated in FIG. 1, the image forming apparatus 100 is a color laser printer and includes, in the center thereof, four image forming units 1Y, 1C, 1M, and 1BK to form an image of a different color such as yellow (Y), cyan (C), magenta (M), and black (BK) corresponding to decomposed color components of a color image. Each image forming unit 1Y, 1C, 1M, or 1BK includes a photoreceptor 2 as a latent image carrier; a charging roller 3 as a charger to electrically charge a surface of the photoreceptor 2; a developing device 4 to develop the electrostatic latent image formed on the photoreceptor 2 by supplying toner; and a cleaning blade 5 as a cleaner to clean the surface of the photoreceptor 2.

In FIG. 1, reference numerals are given to parts included in the image forming unit 1Y for forming a yellow image, that is, the photoreceptor 2, the charging roller 3, the developing device 4 and the cleaning blade 5 are each applied with a reference numeral, and reference numerals for other parts corresponding to the other image forming units 1M, 1C, and 1BK are omitted. In the present embodiment, each image forming unit 1Y, 1C, 1M, or 1BK integrally includes the photoreceptor 2, the charging roller 3, the developing device 4 and the cleaning blade 5 and is disposed as a process unit detachably attachable to the image forming apparatus 100.

In FIG. 1, an exposure unit 6 to form an electrostatic latent image on the surface of the photoreceptor 2 is disposed above each of the image forming units 1Y, 1M, 1C, and 1BK. The exposure unit 6 includes a light source, a polygonal mirror, an fθ lens, a reflection mirror, and the like, and is configured to irradiate each surface of the photoreceptor 2 with laser beams in patterns that are defined by image data.

On the other hand, a transfer device 7 configured to transfer a toner image to a sheet of paper as recording media is disposed below the image forming units 1Y, 1C, 1M, and 1BK. The transfer device 7 includes an endless intermediate transfer belt 8 as an intermediate transfer body. The intermediate transfer belt 8 is stretched over a drive roller 9 and a driven roller 10, each serving as a support member, and when the drive roller 9 rotates in the counterclockwise direction as shown in the figure, the intermediate transfer belt 8 is driven to rotate cyclically in a direction as indicated by an arrow in the figure.

The four primary transfer rollers 11 each are disposed at a position opposed to a corresponding one of the photoreceptors 2. Each primary transfer roller 11 presses an interior surface of the intermediate transfer belt 8 at each disposed position, and a primary transfer nip is formed at a position where the pressed portion of the intermediate transfer belt 8 contacts each photoreceptor 2. Each primary transfer roller 11 is connected to a power source, not shown, and is supplied with a predetermined direct current voltage (DC) and/or alternating current voltage (AC).

A secondary transfer roller 12 is disposed at a position opposed to the drive roller 9. The secondary transfer roller 12 presses an external surface of the intermediate transfer belt 8 and a secondary transfer nip is formed at a position where the secondary transfer roller 12 contacts the intermediate transfer belt 8. Similarly to the primary transfer rollers 11, the secondary transfer roller 12 is connected to a power source, not shown, and is supplied with a predetermined direct current (DC) voltage and/or alternating current (AC) voltage.

A belt cleaning unit 13 configured to clean the surface of the intermediate transfer belt 8 is disposed on a circumferential surface of the intermediate transfer belt 8 at a right end in the figure. A waste-toner conveying tube, not shown, is extended from the belt cleaning unit 13 and is connected to an inlet port of the waste toner container 14 disposed below the transfer device 7.

A paper tray 15 to contain a sheet P and a sheet feed roller 16 to convey the sheet P from the paper tray 15 are disposed at the bottom of the apparatus 100. Herein, the sheet P includes various types of sheets such as a sheet of cardboard, a postcard, an envelope, plain paper, thin paper, coated paper or art paper, tracing paper, and the like. An OHP sheet or film may be used as recording media.

Further, a pair of sheet discharge rollers 17 to discharge the recording media outside the apparatus is disposed above the body of the apparatus 100. In addition, a sheet discharge tray 18 to stack the sheet discharged outside the apparatus is disposed on an upper surface of the apparatus 100.

The sheet P is conveyed from the paper tray 15 via the secondary transfer nip to the sheet discharge tray 18 through a conveyance path R. A pair of registration rollers 19 serving as a timing roller to convey the sheet P to the secondary transfer nip at an appropriate timing for conveyance is disposed upstream in the sheet conveyance direction of the secondary transfer roller 12 in the conveyance path R. On the other hand, a fixing device 20 to fix an unfixed image transferred on the sheet P is disposed downstream in the sheet conveyance direction than the position of the secondary transfer roller 12.

Next, with reference to FIG. 1, basic operation of the printer according to an embodiment of the present invention will be described.

When an image forming operation is started, each photoreceptor 2 of each of the image forming units 1Y, 1C, 1M, and 1BK is driven by a driving device, not shown, to rotate in a clockwise direction as illustrated in FIG. 1, and each surface of the photoreceptor 2 is uniformly charged at a predetermined polarity by the charging roller 3. Based on the image data of the document read by the image reader, not shown, the exposure unit 6 irradiates the charged surface of each photoreceptor 2 with laser beams to form an electrostatic latent image on the surface of each photoreceptor 2. In this case, the image data exposed on each photoreceptor 2 is monochrome image data decomposed, from the target full-color image, into color data of yellow, cyan, magenta, and black. Each developing device 4 supplies toner to the electrostatic latent image formed on the photoreceptor 2, and the electrostatic latent image is rendered visible as a toner image or a developer image.

When the image forming operation is started, the intermediate transfer belt 8 is driven to rotate in the direction indicated by an arrow in the figure. Further, a constant voltage or constant-current controlled voltage having an opposite polarity to the polarity of the charged toner is applied to each primary transfer roller 11. Accordingly, a transfer electric field is formed at a primary transfer nip.

Thereafter, upon the toner image of each color formed on the photoreceptor 2 reaching the primary transfer nip associated with the rotation of each photoreceptor 2, the toner image of each color formed on each photoreceptor 2 is sequentially transferred in a superposed manner on the intermediate transfer belt 2 by the transfer electric field formed in the primary transfer nip. Thus, a full-color toner image is carried on the surface of the intermediate transfer belt 8. In addition, the toner not transferred to the intermediate transfer belt 8 and remaining on each photoreceptor 2 is removed by the cleaning blade 5. Thereafter, the surface of each photoreceptor 2 is subjected to a discharging operation by a discharger, not shown, and the surface potential is initialized and is ready for a next image formation.

The sheet feed roller 16 is started to rotate so that the sheet P is sent out from the paper tray 15 to the conveyance path R. The sheet P fed out to the conveyance path R is sent to the secondary transfer nip at a timing defined by a pair of registration rollers 19. In this case, because the transfer voltage having a polarity opposite that of the charged toner of the toner image on the intermediate transfer belt 8 is applied to the secondary transfer roller 12, a transfer electric field is formed at the secondary transfer nip.

Thereafter, upon the toner image formed on the intermediate transfer belt 8 reaching the secondary transfer nip associated with the rotation of the intermediate transfer belt 8, the toner image on the intermediate transfer belt 8 is transferred en bloc to the sheet P via the transfer electric field generated in the secondary transfer nip.

Thereafter, the sheet P is conveyed to the fixing device 20, and the toner image on the sheet P is fixed by the fixing device 20 onto the sheet P. The sheet P is then discharged outside the apparatus 100 by the sheet discharge roller 17, and is stacked on the sheet discharge tray 18.

The explanation heretofore relates to an image forming operation when a full-color image is formed on the sheet; however, a monochrome image may be formed using any one of the four image forming units 1Y, 1C, 1M, and 1BK, and an image formed of two or three colors may be possible by using two or three image forming units.

Figure 2:
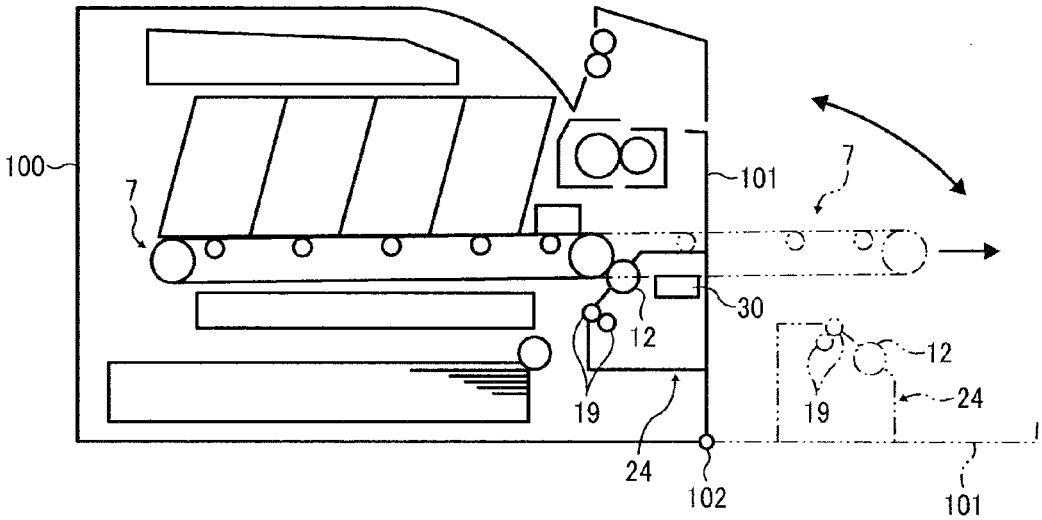
FIG. 2 is a view illustrating how to detach a transfer device from the image forming apparatus.

In addition, as illustrated in FIG. 2, a cover 101 disposed at a front of the apparatus 100 is configured to rotate about a support shaft 102 disposed below the apparatus 100. When the cover 101 is rotated toward the front, a front part of the apparatus 100 is opened. When the cover 101 is opened, a conveyance unit 24 supporting the secondary transfer roller 12 and the pair of registration rollers 19 is retracted from the front of the transfer device 7 together with the opened cover 101. In this state, the transfer device 7 is moved in the horizontal direction and is detached from the apparatus 100.

In addition, as illustrated in FIG. 2, the apparatus 100 is provided with a guide member 30 to support and guide the transfer device 7 when the transfer device 7 is attached to and detached from the apparatus 100. The guide member 30 is disposed at a front side inside the apparatus 100 and supports a surface below the detachable transfer device 7.

Figure 3:
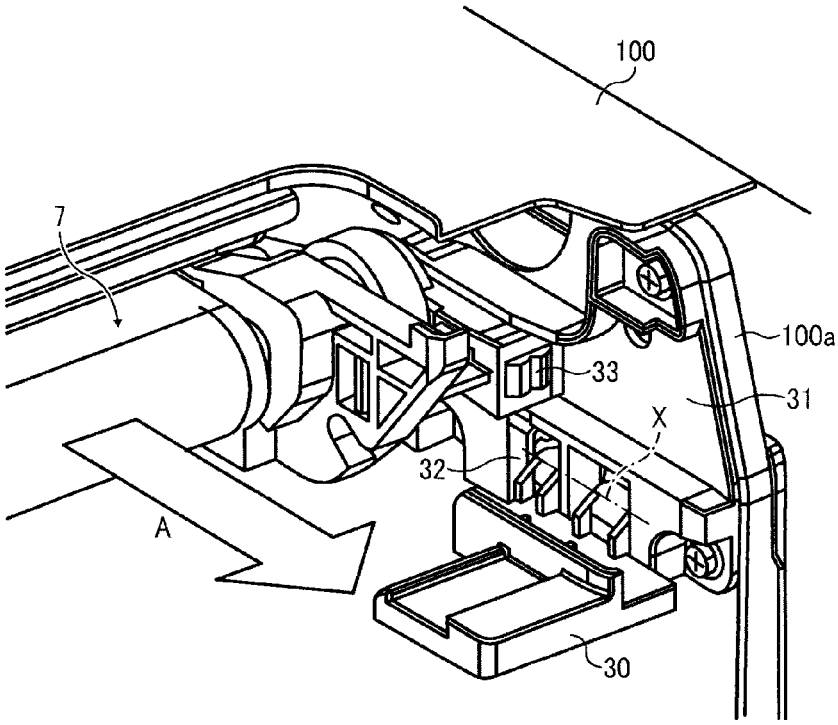
FIG. 3 is a view illustrating a state in which a guide member is disposed substantially horizontally.

FIG. 3 shows a state in which the transfer device 7 and the guide member 30 are observed from the front opening of the apparatus 100 when the cover 101 is opened.

FIG. 3 shows a structure of the guide member 30 disposed on one of the side plates 100*a* of the apparatus 100; however, another guide member 30 is disposed on the other side plate 100*a* in the opposite side, not shown. Because the guide members 30 are symmetrically disposed, one of the guide members 30 as illustrated in FIG. 3 will be explained as an example for simplifying the description.

As illustrated in FIG. 3, the guide member 30 is mounted to an inner wall of the side plate 100*a* of the apparatus 100 via a support member 31. In addition, the guide member 30 is configured to rotate about its axis of rotation X thereof substantially parallel to the detachment direction A of the transfer device 7.

Figure 4:
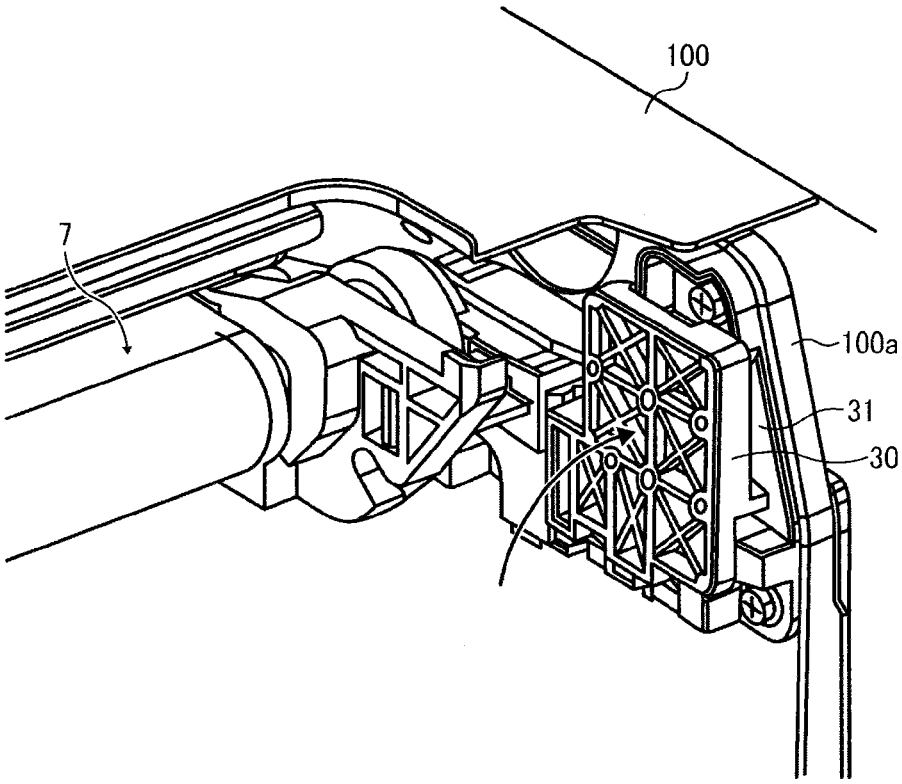
FIG. 4 is a view illustrating a state in which a guide member is disposed substantially vertically.

FIG. 4 shows a state in which the guide member 30 is rotated upward from the state as illustrated in FIG. 3.

The guide member 30 is disposed substantially horizontally in FIG. 3, and, when the guide member 30 is rotated upward about its axis of rotation X, the guide member 30 is positioned substantially vertically along the inner wall of the apparatus 100 as illustrated in FIG. 4.

When the guide member 30 is disposed substantially horizontally as illustrated in FIG. 3, the guide member 30 comes in a state to guide the transfer device 7 (see FIG. 2). By contrast, when the guide member 30 is disposed substantially vertically as illustrated in FIG. 4, the guide member 30 is retracted to a position in which the guide member 30 does not interfere with a conveyance device 24 disposed on the cover 101 even when the cover 101 is closed.

Figure 5:
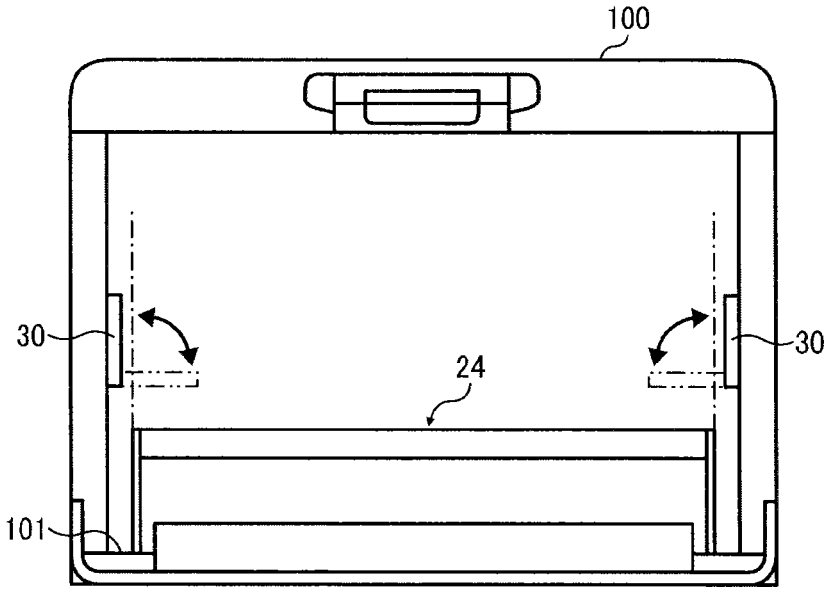
FIG. 5 is a front view of the image forming apparatus when a cover is open.

Specifically, in a state in which the guide member 30 is disposed substantially vertically as illustrated in a front view of FIG. 5, the guide member 30 is positioned outside the conveyance device 24 mounted on the cover 101. As described above, because the guide member 30 is positioned outside a movement locus of the cover 101 and the conveyance device 24 in opening and closing the cover 101, the guide member 30 does not interfere with the cover 101 and the conveyance device 24 when the cover 101 is closed.

On the other hand, when the guide member 30 is disposed substantially horizontally, the guide member 30 is positioned within a space in which the conveyance device 24 is installed in the apparatus 100. As configured as above, an open space created when the cover is opened can be used effectively, so that space-saving and a compact apparatus are realized at the same time.

When the guide member 30 is disposed substantially vertically and the cover 101 is opened, the guide member 30 is preferably positioned at a higher place than any members such as the conveyance device 24 disposed on the cover 101. With this structure, the transfer device 7 in detachment operation does not interfere with the members disposed on the cover 101 so that those members are not damaged easily.

Further, although in the present embodiment the guide member 30 is manually rotated, alternatively the rotation of the guide member 30 can be configured such that a biasing member such as a torsion coil spring is disposed at its axis of rotation X of the guide member 30, and the guide member 30 is returned by the biasing force of the torsion coil spring to substantially the vertical state from substantially the horizontal state.

In FIG. 3, reference numeral 32 shows a retainer that prevents the guide member 30 from being detached from the support member 31. The retainer 32 is formed of an elastic member and is attachably detachable from the support member 31 by a so-called snap-fit method. With this structure, even when the guide member 30 is damaged, the guide member 30 can be replaced by removing the retainer 32.

In addition, as illustrated in FIG. 3, a locking part 33 configured to lock the guide member 30 is disposed to a side of the apparatus 100. In the present case, the locking part 33 includes a groove that extends vertically. As illustrated in FIG. 4, when the guide member 30 is disposed substantially vertically, the edge of the guide member 30 is locked in the groove of the locking part 33 so that the guide member 30 is locked.

Figure 6:
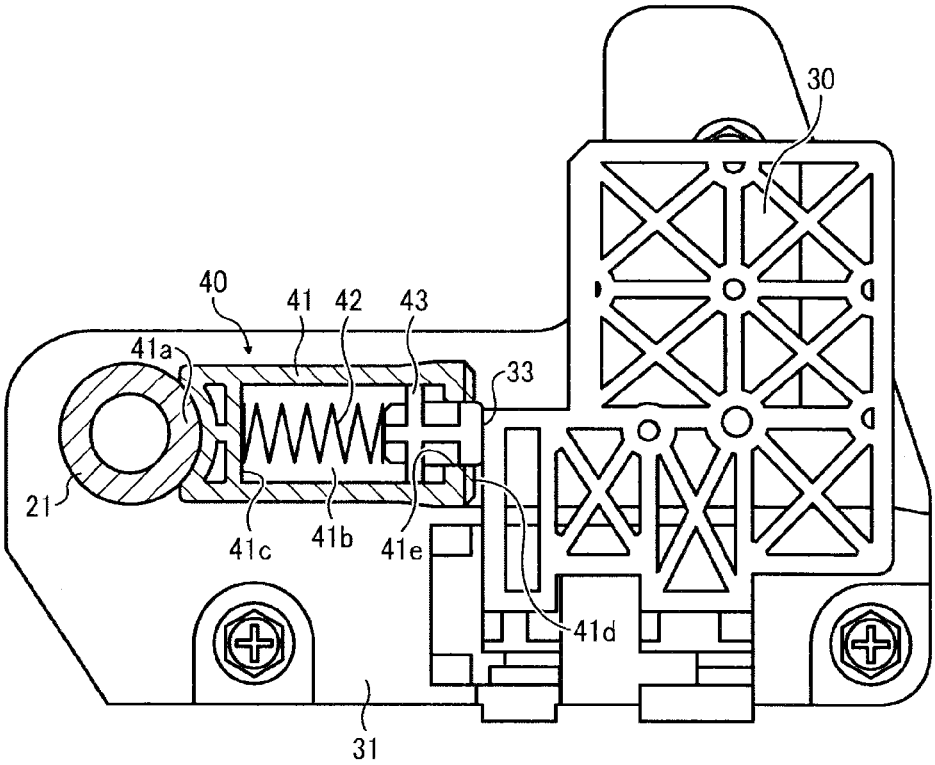
FIG. 6 is a view illustrating a structure of a positioning device to position the transfer device.

FIG. 6 is a view illustrating a structure of a positioning device 40 to position the transfer device 7 relative to the apparatus 100.

As illustrated in FIG. 6, the positioning device 40 includes a pressing member 41 that contacts a bearing 21 of the drive roller 9 in the transfer device 7, a compression spring 42 as an elastic member disposed inside the pressing member 41, and a movable member 43 that contacts one end of the compression spring 42.

An end surface 41*a* of the bearing 21 of the pressing member 41 is arc-shaped along an outer circumferential shape of the bearing 21, and the pressing member 41 contacts the bearing 21 at this arc-shaped end surface 41*a*. In addition, the pressing member 41 and the bearing 21 may be either separately formed or integrally formed. The pressing member 41 includes a hollow center and the compression spring 42 and the movable member 43 are included in the hollow space 41*b*.

The compression spring 42 is so disposed as to be deformable in the attachably detaching direction. A receiving surface 41*c* is provided in the pressing member 41. An end of the compression spring 42 toward the bearing 21 (i.e., the left side in FIG. 6) contacts the receiving surface 41*c*. An opposite end of the compression spring 42 contacts the movable member 43.

A through-hole 41*e* is formed on an end surface 41*d* opposite the end surface 41*a* of the pressing member 41 toward the bearing 21. A part of the movable member 43 is exposed outside the through-hole 41*e*. In addition, the locking part 33 configured to lock the guide member 30 is disposed at the exposed end surface of the movable member 43.

A method to position the transfer device 7 by the positioning device 40 will now be described.

As illustrated in FIG. 4, when the guide member 30 is disposed substantially vertically by rotating it upwardly in a state in which the transfer device 7 is installed inside the apparatus 100, the guide member 30 is locked on the locking part 33 disposed at the movable member 43. At the same time, the movable member 43 is pushed by the guide member 30 and is moved to the left in FIG. 6 to thereby press the compression spring 42. Further, the bearing 21 is pressed by a reaction of the compression spring 42 so that the transfer device 7 is pushed in toward the mounting direction. Then, the transfer device 7 contacts the apparatus 100 and is positioned within the apparatus 100.

In this state as illustrated in FIG. 6, the guide member 30 regulates attachment and detachment of the transfer device 7 relative to the apparatus 100. Accordingly, the transfer device 7 cannot be removed. When the transfer device 7 is removed from the apparatus 100, as illustrated in FIG. 3, the guide member 30 is rotated downward and is positioned substantially horizontally so that the regulation of the guide member 30 is released, and then, the transfer device 7 may be pulled out in the detachment direction.

The guide member 30 according to the present embodiment is switchable between a separation regulating state in which the guide member 30 regulates the transfer device 7 to prevent detachment and keep the transfer device 7 installed in the apparatus 100 and a guidable state in which the guide member 30 supports the transfer device 7 while guiding it.

Hereinafter, a structure to prevent the transfer device 7 from detaching when the transfer device 7 is detached from the apparatus 100 will now be described.

Figure 7:
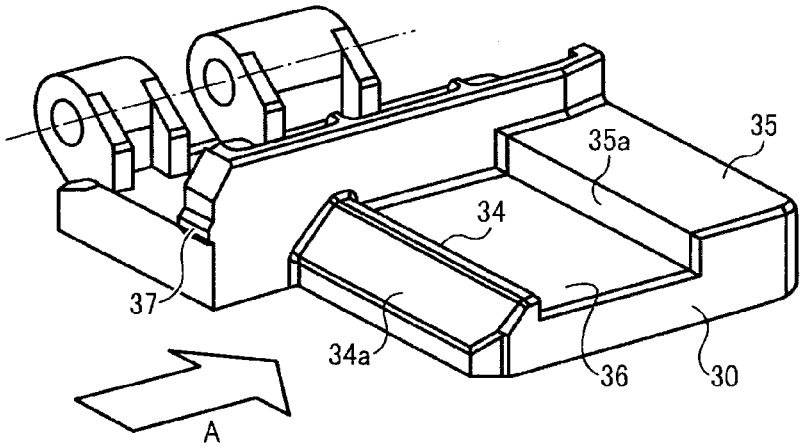
FIG. 7 is a perspective view of the guide member.

FIG. 7 shows a state in which the guide member 30 is brought into a guidable state taking a substantially horizontal posture. In this state, the guide member 30 includes an upper surface to guide the transfer device 7, on which two protrusions 34, 35 are provided. In FIG. 7, the transfer device 7 is detached in the direction of an arrow A. For convenience, among two protrusions 34, 35, the protrusion 34 upstream in the detachment direction A is denoted as a first protrusion 34 and the protrusion 35 downstream in the detachment direction A is denoted as a second protrusion 35.

The first and second protrusions 34, 35 are disposed apart from each other in the detachment direction A and a recess 36 is formed between the two protrusions 34, 35. A slanted surface 34*a* that slants relative to the detachment direction A is formed upstream of the first protrusion 34. On the other hand, an end surface 35*a* upstream of the second protrusion 35 is perpendicular to the detachment direction A.

In FIG. 7, reference numeral 37 shows a convex engaging part that can be engaged with the locking part 33. When the guide member 30 is disposed substantially vertically in the separation regulating state, the engaging part 37 engages with the locking part 33, whereby the guide member 30 is locked.

Figure 8:
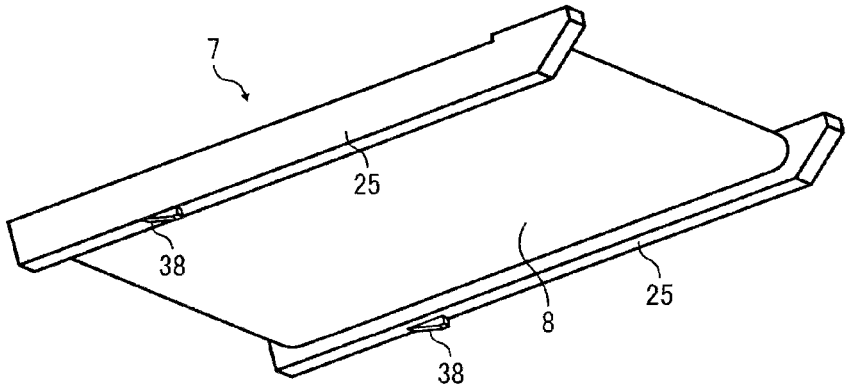
FIG. 8 is a schematic, perspective view of the transfer device seen from a bottom.

FIG. 8 is a schematic, perspective view of the transfer device 7 seen from the bottom.

As illustrated in FIG. 8, the transfer device 7 includes a pair of frame members 25 supporting the drive roller 9 and the driven roller 10. In addition, each frame member 25 includes a projection 38 that contacts the guide member 30 in attaching and detaching the transfer device 7.

Figure 9:
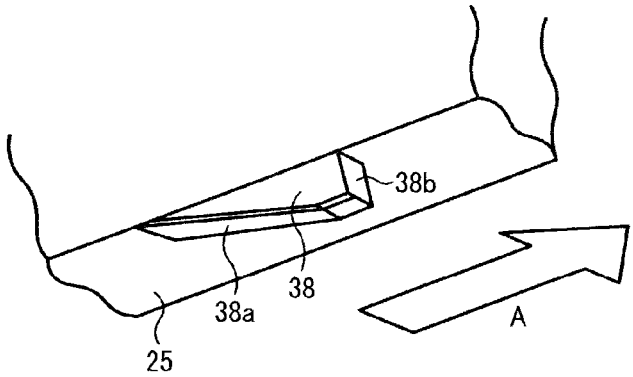
FIG. 9 is an enlarged view of a projection.

FIG. 9 is an enlarged view of the projection 38.

As illustrated in FIG. 9, the projection 38 extends in the detachment direction A of the transfer device 7. The projection 38 includes a slanted surface 38*a* that slants relative to the detachment direction A and an end surface 38*b* opposite the slanted surface 38*a* disposed downstream in the detachment direction is substantially perpendicular to the detachment direction A.

Figure 10A:
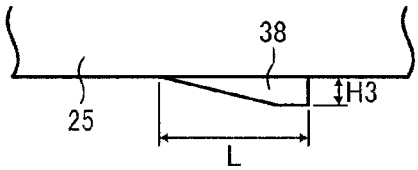
FIGS. 10A and 10B are views illustrating relative dimensions of the projection and two protruded portions.
Figure 10B:
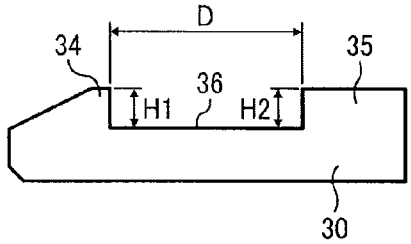

FIGS. 10A and 10B are views illustrating relative dimensions of the projection 38 and the two protrusions 34, 35.

As illustrated in FIGS. 10A and 10B, in the present embodiment, each height H1, H2 of the two protrusions 34, 35 of the guide member 30 is higher than the height H3 of the projection 38. In addition, the distance D between the two protrusions 34, 35 is longer than the distance L of the projection 38 of the transfer device 7 along the detachment direction.

Next, a description will be given of an effect and performance of the retainer device of the present invention.

When the cover 101 is oscillated forward to be open, the guide member 30 is rotated downward to be brought into the guidable state (as illustrated in FIG. 3), the transfer device 7 is pulled out toward the detachment direction, and the transfer device 7 is supported, while being guided, by the guide member 30 (see FIG. 2). In this case, each bottom surface of the frame members 25 of the transfer device 7 contacts an upper surface of the guide member 30 and is guided.

Figure 11A:
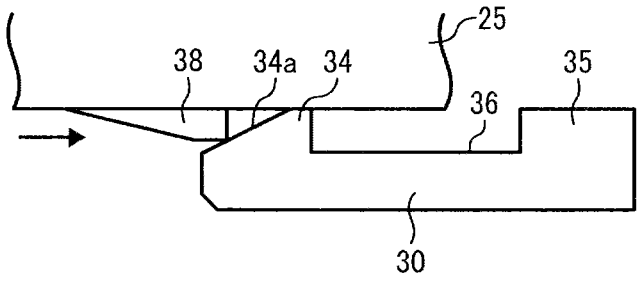
FIGS. 11A to 11C are views illustrating an effect of the guide member when the transfer device is detached.
Figure 11B:
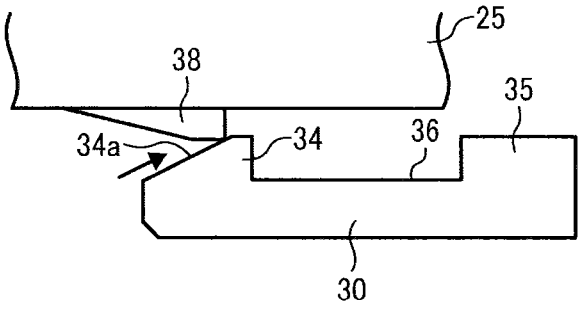
Figure 11C:
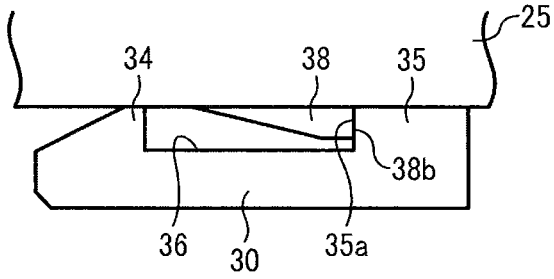

Then, upon each of the projections 38 of the frame members 25 reaching the guide member 30, the projection 38 contacts the slanted surface 34*a* of the first protrusion 34 of the guide member 30 as illustrated in FIG. 11A. When the transfer device 7 is further pulled out in the detachment direction, the projection 38 slides on the slanted surface 34*a* as illustrated in FIG. 11B, thus raising the transfer device 7 slightly. Then, as illustrated in FIG. 11C, when the projection 38 overrides the slanted surface 34*a*, the projection 38 falls and is fitted in the recess 36 between the two protrusions 34, 35 and contacts the end surface 35*a* of the second protrusion 35 upstream. Because the upstream end surface 35*a* and the downstream end surface 38*b* of the projection 38 are formed to be substantially perpendicular to the detachment direction, the projection 38 does not override the second protrusion 35 and the end surfaces 35*a*, 38*b* are contacted each other. As a result, moving of the transfer device 7 further in the detachment direction is regulated.

With this structure, in a state in which moving of the transfer device 7 in the detachment direction is regulated by the contact of the projection 38 with the upstream end surface 35*a*, the rear end of the transfer device 7 is supported by the guide member 30 so as not to fall down. Specifically, the upstream end surface 35*a* of the second protrusion 35 serves as a stopper to stop the transfer device 7 so as not to be fallen when the transfer device 7 is pulled out from the apparatus 100.

Further, when the transfer device 7 is completely removed from the apparatus 100, the transfer device 7 is lifted from the state as illustrated in FIG. 11C so that the projection 38 does not interfere with the second protrusion 35, and further, the transfer device 7 is moved toward the detachment direction.

Even without the first protrusion 34, the second protrusion 35 only may regulate moving of the transfer device 7. However, in the present embodiment, because the first protrusion 34 is provided and a stepped portion that the projection 38 can override is formed, the transfer device 7 contacts the first protrusion 34 and is stopped after having been lifted once and fallen a little, that the transfer device 7 contacts the second protrusion 35, which serves as a stopper, can be recognized easily by a user.

Further, in the present embodiment, to secure a maximum possible depth of the recess of the guide member 30 that the transfer device 7 overrides in the limited space, each height H1, H2 of the two protrusions 34, 35 of the guide member 30 is set longer than the height of the projection 38, and the distance D between the two protrusions 34, 35 is set longer than the length L of the projection 38. With this configuration, the projection 38 can be completely fitted in the recess 36 between the two protrusions 34, 35. As a result, the projection 38 can secure a falling depth after overriding the guide member 30 so that the user can recognize more clearly that the transfer device 7 contacts the stopper.

Figure 12A:
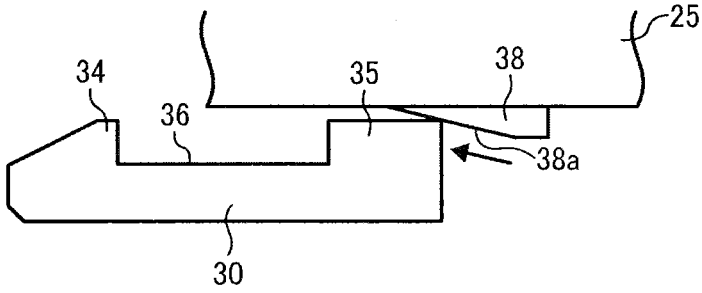
FIGS. 12A to 12C are views illustrating an effect of the guide member when the transfer device is attached.
Figure 12B:
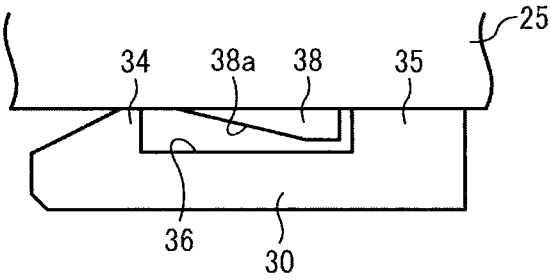
Figure 12C:
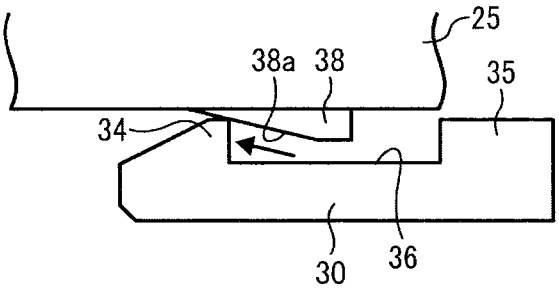

Subsequently, referring to FIGS. 12A to 12C, an effect of the guide member 30 when the transfer device 7 is attached will be described.

When attaching the transfer device 7, the cover 101 is moved forward to be open and, while the guide member 30 being in the guidable state (as illustrated in FIG. 3), the transfer device 7 is placed on the guide member 30 and is moved toward the attachment direction. Upon the projections 38 reaching the position of the guide member 30, the slanted surface 38*a* of each of the projections 38 slides on the edge of the second protrusion 35, so that the projection 38 overrides the second protrusion 35 as illustrated in FIG. 12A. Then, as illustrated in FIG. 12B, the projection 38 that has overridden the second protrusion 35 is installed inside the recess 36. When the transfer device 7 is further moved to be installed, the slanted surface 38*a* of the projection 38 slides on the edge of the first protrusion 34 and overrides the first protrusion 34. Then, by continuously pushing the transfer device 7 into the attachment direction, the transfer device 7 is installed in the apparatus 100 while guided by the guide member 30. As descried above, when the guide member 30 is rotated to be brought into the separation regulating state (as illustrated in FIG. 4), the movable member 43 is pushed by the guide member 30 and the transfer device 7 is pushed in the attachment direction and positioned.

In addition, when the guide member 30 is switched to the guidable state to be positioned substantially horizontally, the guide member 30 is disposed to be fitted into the space where the conveyance device 24 is installed (see FIGS. 2 and 5). Accordingly, in this state, when the cover 101 is to be closed, because the guide member 30 is on a moving locus of the conveyance device 24, the conveyance device 24 interferes with the guide member 30. As a result, the cover 101 is prevented from opening.

The cover 101 is erroneously closed and image forming operation does not start because of the configuration as described above, even when the guide member 30 is not switched to the separation regulating state (or substantially the vertical direction), that is, in a state in which the transfer device 7 is not positioned at a proper position by the guide member 30. Accordingly, any damage to the transfer device 7 or low-quality image prints due to the load by the erroneous drive of the transfer device 7 which has not been installed properly can be prevented.

Figure 13:
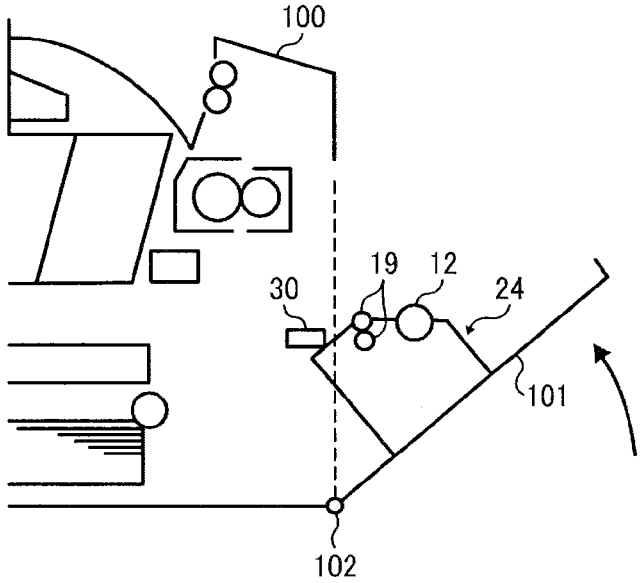
FIG. 13 is a view illustrating a state in which a conveyance device disposed on the cover interferes with the guide member.

Further, as illustrated in FIG. 13, the conveyance device 24 contacts the guide member 30 at portions other than the registration roller pair 19 or the secondary transfer roller 12. Because the contact with the registration roller pair 19 or the secondary transfer roller 12 is prevented, disadvantageous effect to the sheet conveyance function or the image transfer function is prevented.

It can be configured such that the cover 101 interferes with the guide member 30 so that the cover 101 is prevented from closing erroneously. In such a case, the guide member 30 is so configured as to position on the moving locus of the cover 101 in opening and closing operation, in a state in which the guide member 30 is switched to the guidable state (or is disposed substantially horizontally).

Hereinafter, referring to FIGS. 14 to 19, a second embodiment of the present invention will be described.

Figure 14:
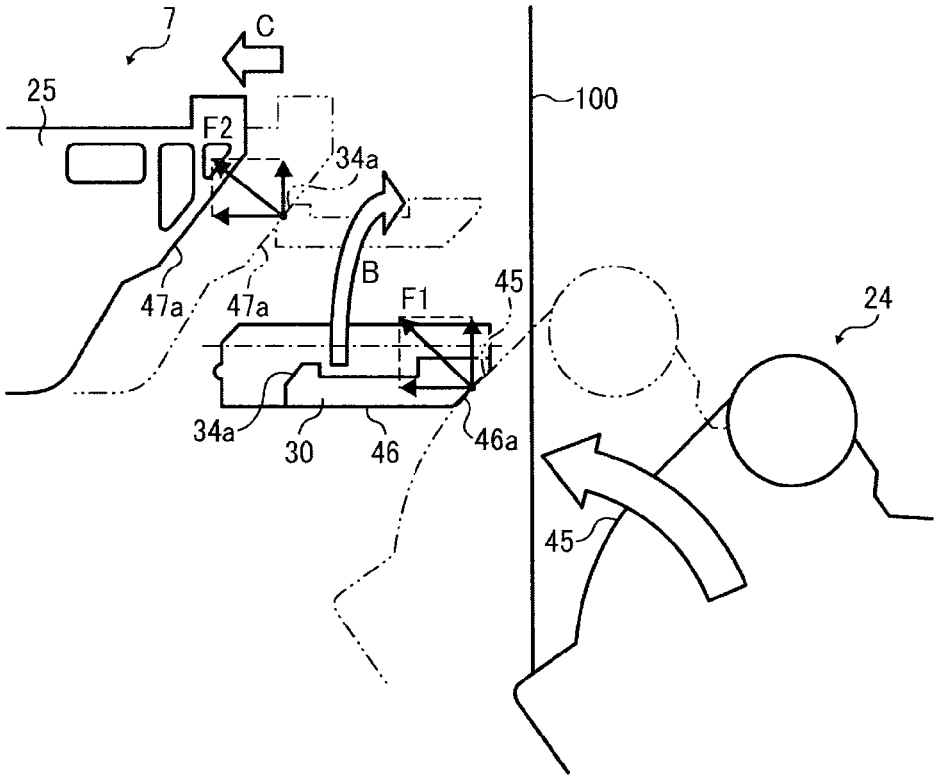
FIG. 14 is a side view illustrating another embodiment of the present invention.
Figure 15:
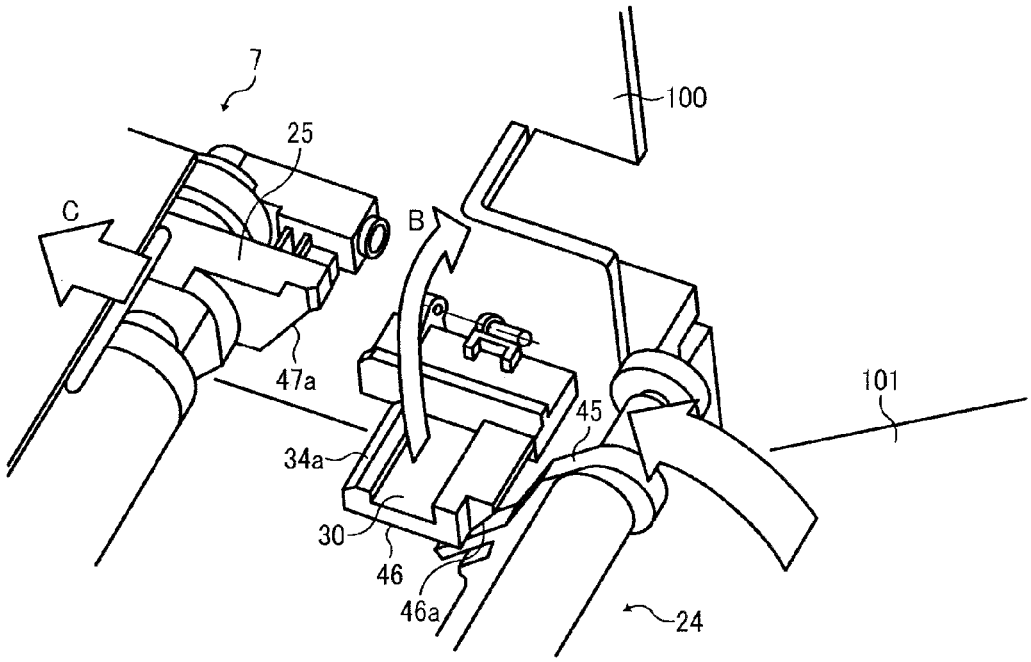
FIG. 15 is a perspective view illustrating another embodiment of the present invention.

FIG. 14 is a side view in which the conveyance device 24 disposed on the cover contacts the guide member 30 when the cover is closed in a state where the guide member 30 is guidable, and FIG. 15 shows a perspective view of FIG. 14.

As illustrated in FIGS. 14 and 15, similarly to the previous embodiment, when the cover is closed in a state in which the guide member 30 is disposed at a guidable state (substantially horizontal direction), the conveyance device 24 disposed on the cover interferes with the guide member 30. Herein, in the second embodiment, one of the points of difference with the previous embodiment is that the contacted portion of the guide member 30 that the conveyance device 24 contacts is a slanted surface 46*a*. The slanted surface 46*a* is disposed on a rear surface 46 of the guide member 30 opposite the guide surface that the guide member 30 guides the transfer device 7. The slanted surface 46*a* has a slant with respect to a rotary direction indicated by an arrow B of the guide member 30.

Thus, in the second embodiment, because the slanted surface 46*a* is disposed on the rear side 46 of the guide member 30, upward component force of a contact force F1 in FIG. 14 caused by contact between the slanted surface 46*a* and the conveyance device 24 is exerted in a rotary direction B. With this structure, the guide member 30 can be switched from the guidable state (in substantially the horizontal posture) to the separation regulation state (in substantially the vertical posture) due to the pushing force resulted from the contact between the conveyance device 24 and the slanted surface 46*a*.

Further, in the second embodiment, a sheet guide 45 included in the conveyance device 24 contacts the slanted surface 46*a*; however, it is configured such that other portion, as far as it does not cause any disadvantageous effect to the sheet conveyance function and image transfer function, may contact the slanted surface 46*a*. In addition, it can be configured such that the cover 101 directly contacts the guide member 30 and, with this contact, the guide member 30 can be switched to the separation regulating state at the same time.

Further, in the second embodiment, the slanted surface 34*a* similar to the previous embodiment is disposed on the guide surface of the guide member 30. When the transfer device 7 is positioned closer to a proximal side than a predetermined position relative to the apparatus 100, i.e., at a dashed position in FIG. 14, if the guide member 30 is rotated to switch to the separation regulation state, the slanted surface 34*a* contacts a slanted surface 47*a* disposed on a frame member 25 of the transfer device 7.

Then, upon the slanted surface 34*a* of the guide member 30 contacting the slanted surface 47*a* of the frame member 25, a contact force F2 is exerted in the slanted surface 47*a* of the frame member 25. Herein, because the slanted surface 47*a* of the frame member 25 is slanted with respect to the positioning direction of the transfer device 7 as indicated by an arrow C in the figure, leftward component force in FIG. 14 of the contact force F2 is exerted in a positioning direction C. As a result, due to the force exerted toward the positioning direction C, the transfer device 7 is moved and positioned.

Figure 16:
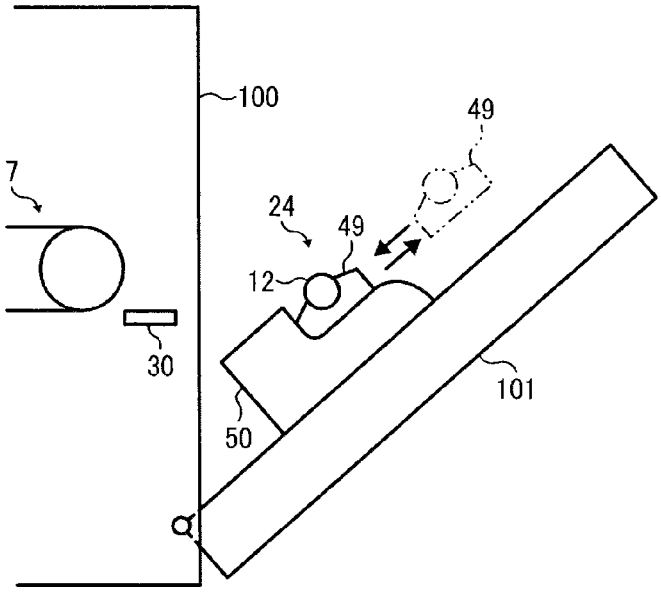
FIG. 16 is a side view illustrating a state in which a secondary transfer unit is detached.
Figure 17:
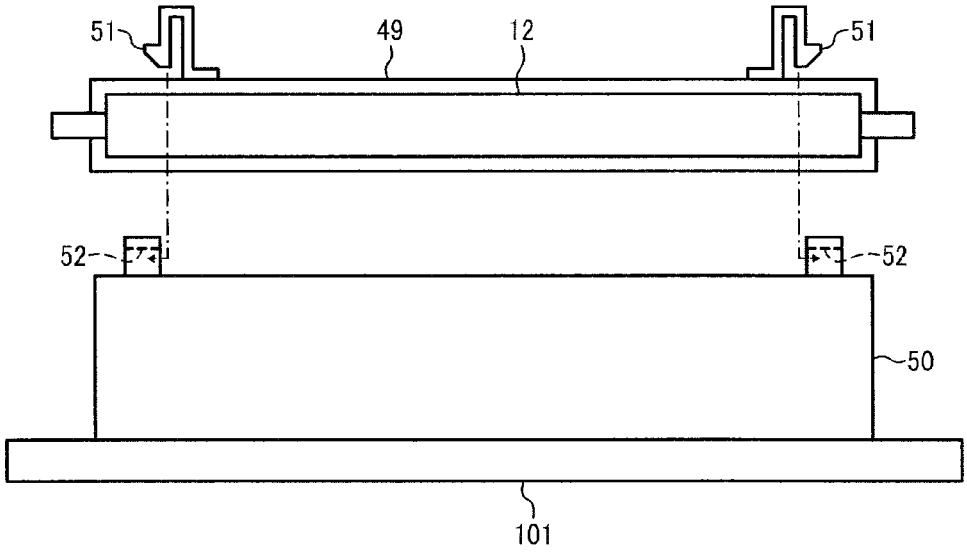
FIG. 17 is a front view illustrating a fitting means of the secondary transfer unit.

Further, as illustrated in FIG. 16, a secondary transfer unit 49 which supports the secondary transfer roller 12 is attachably detachable from a fixed member 50 fixed on the cover 101. Further, as illustrated in FIG. 17, a pair of locking parts 51 to fix the fixed member 50 relative to the secondary transfer unit 49 is disposed at both lateral longitudinal ends (along the secondary transfer roller axis) of the secondary transfer unit 49. By contrast, the fixed member 50 includes an engaging parts 52 each configured to engage the locking part 51, respectively.

Figure 18A:
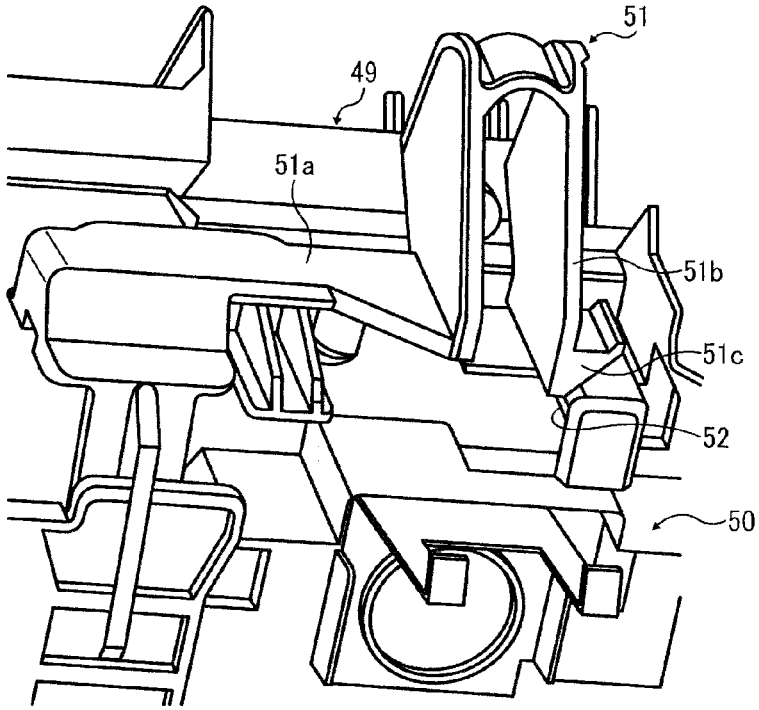
FIGS. 18A and 18B are enlarged views of a locking part.
Figure 18B:
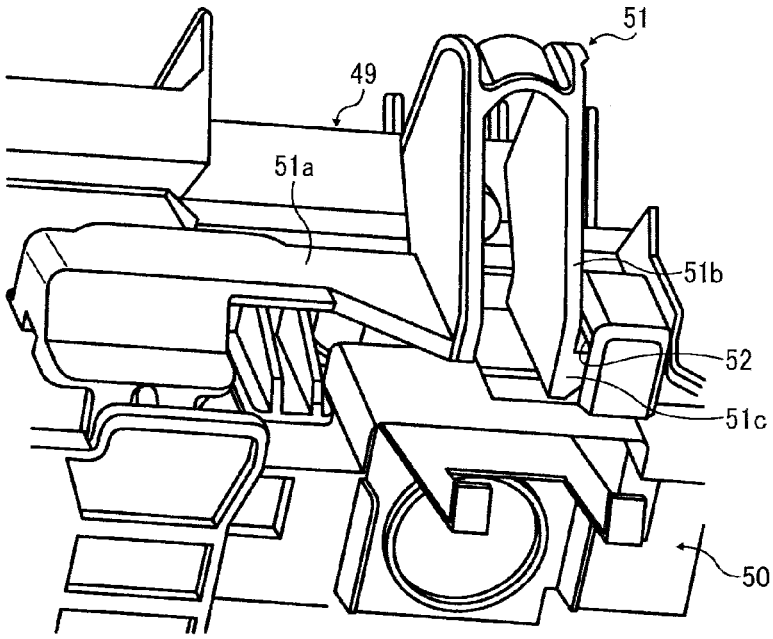

FIGS. 18A and 18B are enlarged views of the locking part 51.

As illustrated in FIG. 18A, the locking parts 51 is formed in substantially U-shape, and one end 51*a* is fixed to the secondary transfer unit 49 and another end 51*b* is a free end. In addition, another free end 51*b* of the locking part 51 includes a claw 51*c*.

In mounting the secondary transfer unit 49 to the fixed member 50, hold both end parts 51*a*, 51*b* of the locking part 51 with fingers to allow the free end 51*b* to elastically approach the fixed end 51*a*. In this state, place the secondary transfer unit 49 on the fixed member 50 at a position where the claw 51*c* corresponds to the engaging parts 52 and disengage the finger from the locking part 51, so that the claw 51*c* engages with the engaging parts 52 due to elastic restoring force and the secondary transfer unit 49 is fixed to the fixed member 50 as illustrated in FIG. 18B.

In addition, without elastically deforming the locking parts 51 with fingers, if the secondary transfer unit 49 is pushed toward the fixed member 50, the locking parts 51 and the fixed member 50 contact each other so that the locking parts 51 are elastically deformed. As a result, the secondary transfer unit 49 is securely mounted to the fixed member 50. In addition, when removing the secondary transfer unit 49 from the fixed member 50, the free end 51*b* of the locking parts 51 is elastically deformed so as to approach the fixed end 51*a*. Then, the locking state is released and the secondary transfer unit 49 can be pulled out.

Because the secondary transfer unit 49 is configured to be attachably detachable, when the cover is closed in a state where the secondary transfer unit 49 is not correctly mounted, for example, in a state where the claw 51*c* as illustrated in FIG. 18A is not properly engaged with the engaging parts 52, the secondary transfer roller may not be positioned at a proper position, which may result in an adverse effect to the image formation. As a result, it is preferable to confirm, before closing the cover, whether or not the secondary transfer unit 49 is correctly mounted. However, it is difficult to confirm visually whether the mounting has been done correctly or not due to the lack of space inside contemporary, compact image forming apparatuses.

As conceivable methods to prevent such erroneous mounting, one is to confirm erroneous mounting of the secondary transfer unit using a sensor; another is to prevent the cover from being closed by causing the secondary transfer unit to interfere with a part of the image forming apparatus in a case of the erroneous mounting. The method to use a sensor may increase manufacturing costs; the method to allow the secondary transfer unit to interfere with another part may cause a trouble for a user who cannot understand the reason why the cover does not close. Neither method provides a solution, because if erroneous mounting occurs, the user again opens the cover and resets the secondary transfer unit, which is troublesome.

The second embodiment provides the following structure to solve such a problem.

Figure 19A:
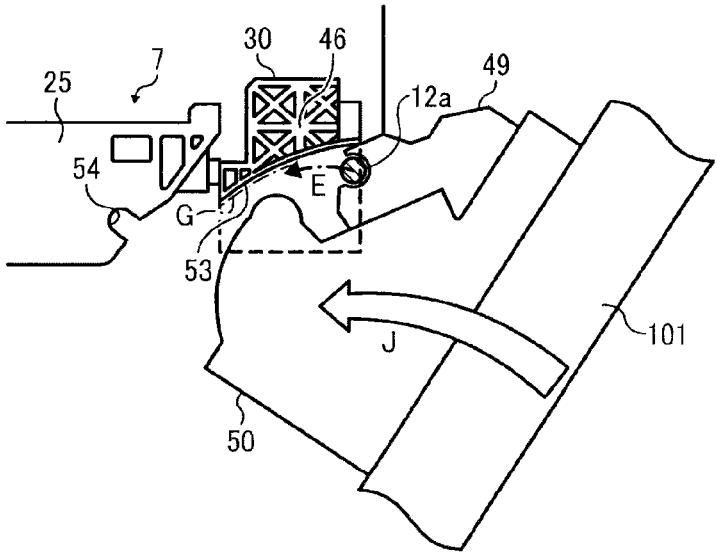
FIGS. 19A to 19C are side views each illustrating a state in which a secondary transfer unit is guided.
Figure 19B:
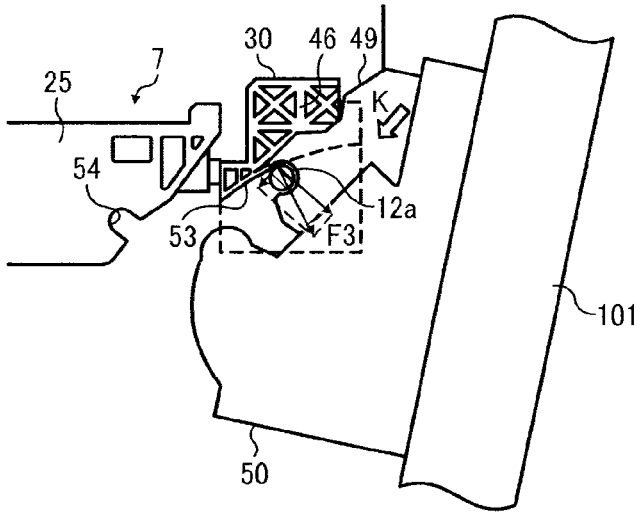
Figure 19C:
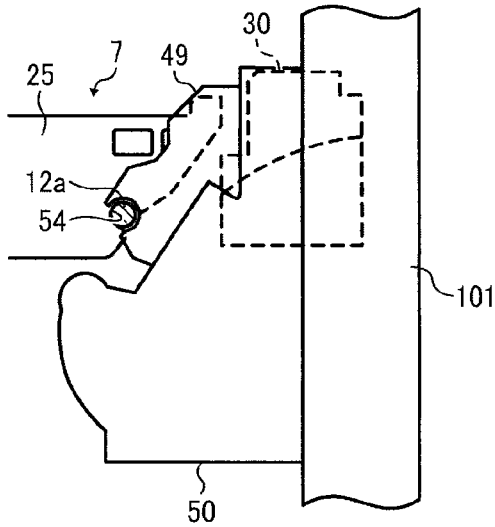

Specifically, as illustrated in FIGS. 19A-19C, a guide portion 53 which guides the secondary transfer unit 49 in a mounting direction is disposed on the rear side 46 of the guide member 30. In this case, a rotary axis 12*a* of the secondary transfer roller 12 is a guided part to be guided by the guide portion 53.

The guide portion 53 includes an arc shape and its locus G (see FIG. 19A) is configured to approach in a direction to close the cover 101 as indicated by an arrow J in the figure with respect to a moving locus E of its axis of rotation 12*a* of the secondary transfer roller 12. In addition, the guide member 30 may be formed linearly or in a form mixed with a straight line and a curved line.

With the thus-configured guide portion 53, its axis of rotation 12*a* of the secondary transfer roller 12 contacts the guide portion 53 as the cover 101 is being closed, and its axis of rotation 12*a* receives a pressing force F3 from the guide portion 53 (see FIG. 19B). A component force of the pressing force F3 (directed to left oblique downwardly in FIG. 19B) is exerted in the same direction as the mounting direction of the secondary transfer unit 49 as indicated by an arrow K in the figure, so that the secondary transfer unit 49 is introduced to the mounting direction K by this force. As a result, even when the secondary transfer unit 49 is not correctly mounted, the secondary transfer unit 49 can be mounted and fixed with respect to the fixed member 50 along with the operation to close the cover 101.

Figure 20:
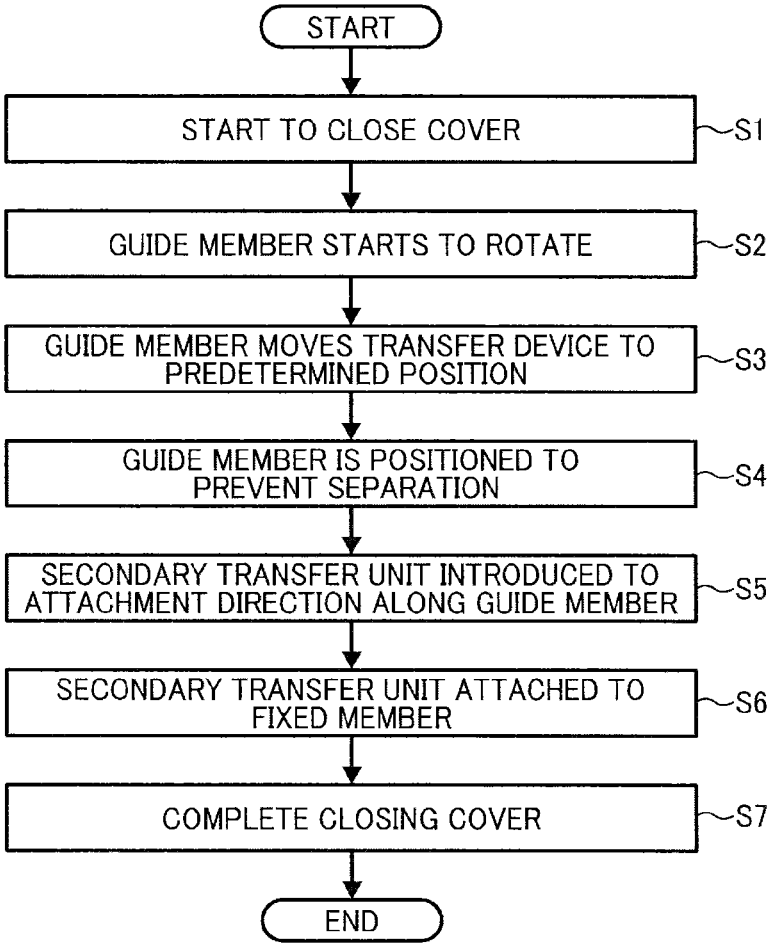
FIG. 20 is a flowchart showing steps in the operation of the secondary transfer unit guided by the guide member.

Next, referring to the flowchart shown in FIG. 20, operation according to the present embodiment will now be described.

First, in a state in which the guide member 30 is disposed substantially horizontally in the guidable state, the cover 101 is started to be closed in step S1. The conveyance device 24 disposed on the cover 101 contacts the slanted surface 46*a* of the rear surface of the guide member 30 (see FIG. 14). With this contact, the guide member 30 starts to rotate and comes into the separation regulating state being disposed substantially vertically (S2). At this time, when the transfer device 7 is positioned at a proximal side in the mounting direction than the predetermined position with respect to the apparatus 100, the slanted surface 34*a* of the guide member 30 contacts the slanted surface 47*a* of the transfer device 7. With this contact, the transfer member 7 is moved in a positioning direction with respect to the apparatus 100 (S3). Thereafter, when the guide member 30 is positioned in the separation regulating state (substantially vertical posture) with respect to the apparatus 100 (S4), the transfer device 7 is positioned with respect to the apparatus 100 via the positioning device 40 (see FIG. 6).

In addition, when the guide member 30 comes into the separation regulating state (substantially the vertical direction), as described in FIG. 19, the guide portion 53 on the rear side is positioned to direct toward inside. In this case, when the secondary transfer unit 49 is not properly mounted to the fixed member 50, its axis of rotation 12*a* slides along the guide portion 53 as the cover 101 is being closed, so that the secondary transfer unit 49 is guided to a mounting direction K (S5). Then, the locking parts 51 of the secondary transfer unit 49 engage with the engaging parts 52 of the fixed member 50, so that the secondary transfer unit 49 is attached and fixed to the fixed member 50 (S6).

In a state in which the cover 101 is completely closed (S7), its axis of rotation 12*a* of the secondary transfer roller 12 is fitted in a positioning recess 54 disposed on the frame member 25 of the transfer device 7 and is positioned properly as illustrated in FIG. 19C.

As described above, in the second embodiment, even though the guide portion 53 is in the guidable state when the cover 101 is to be closed, the guide member 30 can be rotated and switched to the separation regulating state by a rotation to close the cover 101. In addition, even though the transfer device 7 is not positioned at the predetermined position when the cover 101 is to be closed, the transfer device 7 is pushed and moved to the predetermined position by the rotary movement of the guide member 30 by the rotation to close the cover 101. Further, even though the secondary transfer unit 49 is not properly mounted to the fixed member 50 when the cover 101 is to be closed, the secondary transfer unit 49 can be guided to the proper mounting direction and comes into a proper mounting state via the operation to close the cover 101.

According to the structure as described above, the operation to close the cover 101 allows the guide member 30, the transfer device 7, and the secondary transfer unit 49 to be set properly, respectively. Therefore, even in a case of erroneous setting of those devices, there is no need of resetting the devices by reopening the cover 101, thereby improving the operability. Further, damages including malfunction, interference of parts caused by opening the cover 101 in the state in which the guide member 30, the transfer device 7, and the secondary transfer unit 49 are erroneously set can be prevented, thereby improving the reliability.

In the present embodiment, a structure to set all of the guide member 30, the transfer device 7, and the secondary transfer unit 49 at each proper state has been described heretofore; however, a structure to set one or two of the above devices at each proper state may be selectively implemented in the present invention.

Further, in the present embodiment, when the cover 101 is closed, the guide member 30 is rotated and switched to the separation regulating state (S4). Thereafter, the guide portion 53 directed to the inner direction guides the secondary transfer unit 49 toward the mounting direction (S5). To realize the above operation flow, the following structure is employed.

Figure 21:
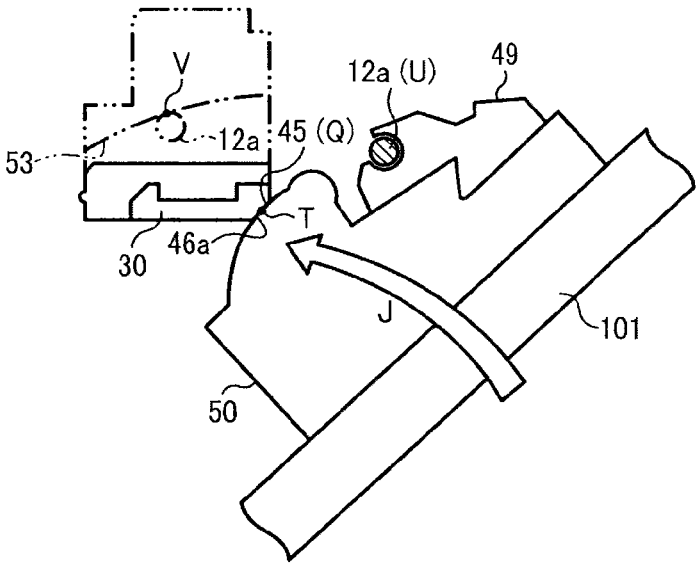
FIG. 21 is a view showing a positional relation between a contact portion and a guided member and a positional relation between a contact start point and a guiding start point.

As illustrated in FIG. 21, a contact portion Q which serves as a conveyance guide 45 and contacts the guide member 30, is disposed on the fixed member 50 at the side of the cover 101. A guided portion U guided by the guide portion 53 is its axis of rotation 12*a* of the secondary transfer roller 12. The contact portion Q is disposed downstream of the guided portion U in a cover closing direction J. A point T at which the contact portion Q starts to contact the guide member 30 is upstream, in the cover closing direction J, of a point V at which the guided portion U starts to be guided by the guide portion 53 in the cover closing direction J.

By setting the positional relations between the contact portion Q and the guided portion U, and between the contact start point T and the start-to-be-guided point V as above, first, the guide member 30 is rotated and switched to the separation regulating state, and then, the secondary transfer unit 49 is guided to the mounting direction by closing the cover 101.

Except the structure according to the second embodiment described based on FIGS. 14 to 21, the other configuration is the same as described referring to FIGS. 1 to 12, and therefore, the redundant explanation of the same configuration will be omitted.

The present invention is not limited to the above-described embodiments and various modifications can be added without distorting from the subject matters of the present invention. For example, in the above embodiments, the slanted surface 34*a* is disposed on the first protrusion 34 so that the projection 38 can override the first protrusion 34 easily when the transfer device 7 is detached. However, the slanted surface may be disposed on the projection 38 instead. Alternatively, the slanted surface may be provided to both the projection 38 and the first protrusion 34. Similarly, when the transfer device 7 is mounted, a slanted surface may be disposed on the second protrusion 35 or both the second protrusion 35 and the projection 38, so that the projection 38 can override the second protrusion 35 easily.

In the preferred embodiments, the anti-drop for the transfer device which includes an intermediate transfer belt has been described heretofore. However, the retainer device according to the present invention may be applied to other devices disposed detachably to the image forming apparatus, such as a waste toner container. The above embodiments may be applied to, without limiting to the color laser printer according to the present invention, monochrome printers, various types of copiers, facsimile machines, or multifunction apparatuses combining the functions of the above devices.

Figure 22:
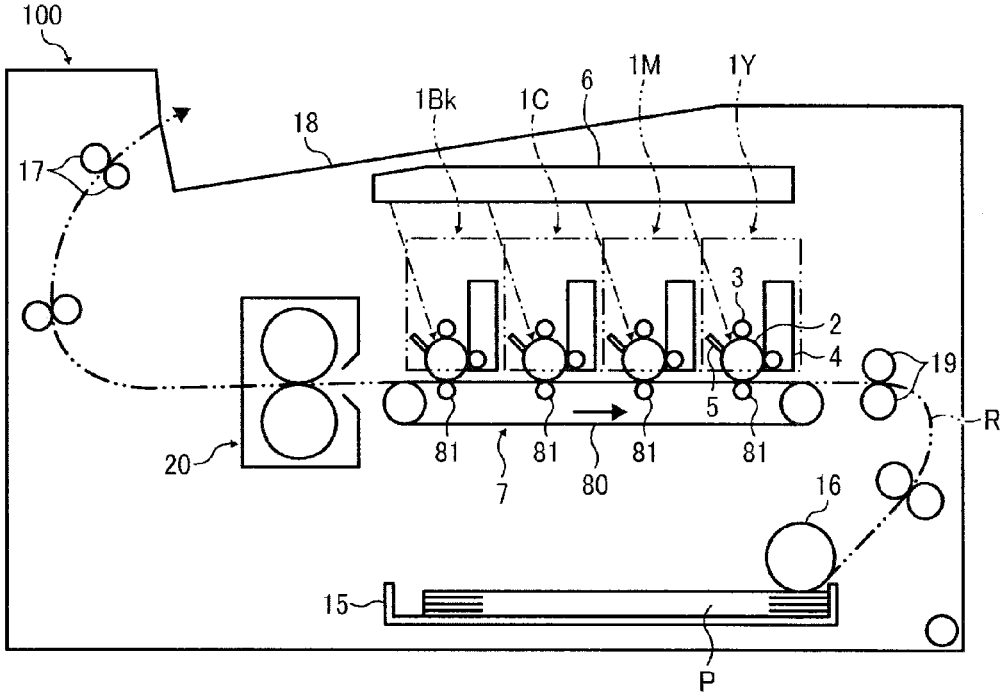
FIG. 22 is a schematic view of another image forming apparatus to which a retainer device according to the present invention is applied.

FIG. 22 is a schematic view of another image forming apparatus to which a retainer device according to the present invention is applied.

The image forming apparatus as illustrated in FIG. 1 employs an intermediate transfer method, in which a toner image on the photoreceptor 2 is transferred to the sheet of paper via the intermediate transfer belt 8. The image forming apparatus as illustrated in FIG. 22 employs a so-called direct transfer method, in which the image on the photoreceptor 2 is transferred to the sheet of paper directly. Specifically, in the structure as illustrated in FIG. 22, the transfer device 7 includes an endless sheet conveyance belt 80 stretched around a plurality of rollers. The sheet P supplied via the sheet feed roller 16 is carried on the sheet conveyance belt 80 via the registration roller pair 19, and is conveyed by a rotation of the sheet conveyance belt 80. In this case, the toner image formed on each photoreceptor 2 in each of the image forming units 1Y, 1M, 1C, and 1BK is transferred to a sheet P on the sheet conveyance belt 80 at positions of a plurality of transfer rollers 81. Then, the sheet P on which the toner image has been transferred is conveyed to the fixing device 20, and after the image has been fixed onto it by the fixing device 20, the sheet P is discharged outside the apparatus by the sheet discharge rollers 17. In FIG. 22, a part which is supplied with the same reference numeral as in FIG. 1 includes the same function and a redundant explanation thereof will be omitted.

Figure 23:
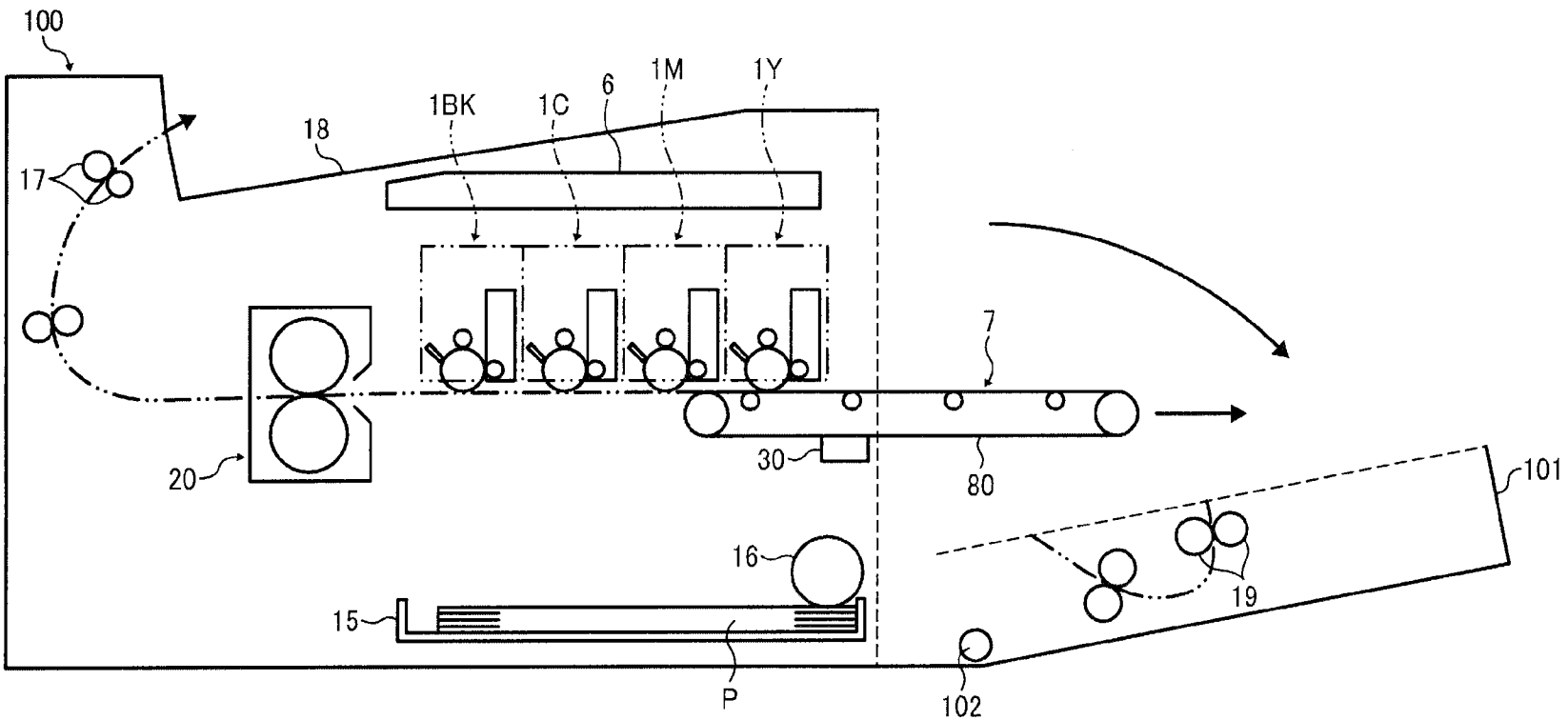
FIG. 23 is a view illustrating a structure of an image forming apparatus of FIG. 22 including a retainer device according to an embodiment of the present invention.

In addition, as illustrated in FIG. 23, the cover 101 disposed at a front of the apparatus 100 is configured to oscillate about the support shaft 102. In this case, when the cover 101 is rotated to be left open, the pair of registration rollers 19 and the like is retracted along with the cover 101 from a front side of the sheet conveyance belt 80. In this state, the transfer device 7 becomes horizontally removable from the apparatus 100.

In the thus-configured image forming apparatus, the retainer device (or the guide member 30 as described above) configured to prevent the transfer device 7 from dropping can be provided, thereby preventing the transfer device 7 from dropping when detached from the image forming apparatus. Accordingly, damage to the transfer device 7, the cover 101, or the registration roller pair 19 disposed on the cover 101 due to the dropping of the transfer device 7 can be prevented effectively.

In the thus-configured image forming apparatus, because dropping of the detachable units when detached from the image forming apparatus can be prevented, damage to the detachable units can be effectively prevented. In addition, because the leg member need not be provided to the transfer device 7 according to the structure of the present embodiment, a compact apparatus can be provided.

Further, because the transfer device 7 can be fitted to the image forming apparatus via the guide member 30, there is no need to provide another means to fixedly positioning the transfer device 7. Thus, a more compact apparatus can be provided.

Additional modifications and variations of the present invention are possible in light of the above teachings. It is therefore to be understood that, within the scope of the appended claims, the invention may be practiced other than as specifically described herein.

What is claimed is:

1. A retainer device included in an image forming apparatus, the image forming apparatus comprising a unit detachably attached to the image forming apparatus, wherein the retainer device prevents the unit from dropping when detached from the image forming apparatus, comprising:

a guide member disposed at a proximal side inside the apparatus to supportably guide the unit with respect to the image forming apparatus when the unit is detached from the image forming apparatus; and a stopper, disposed on the guide member, configured to contact the unit when the unit is moving in a direction separating from the image forming apparatus and to stop the unit from dropping from the image forming apparatus, wherein the guide member is switchable between a first separation regulating state, in which the guide member prevents the unit from detaching from the image forming apparatus, and a second guidable state, in which the guide member supports the unit, while guiding the unit, in the direction separating from the image forming apparatus when the unit is detached from the image forming apparatus.

2. The retainer device as claimed in claim 1, wherein:

the guide member is disposed substantially vertically along an inner wall of the image forming apparatus in the first separation regulating state, and is disposed substantially horizontally in the second guidable state.

3. The retainer device as claimed in claim 1, wherein:

the guide member includes a stepped portion which the unit contacts and overrides before contacting the stopper.

4. The retainer device as claimed in claim 3, wherein:

the stepped portion of the guide member includes a first protrusion and a second protrusion, the first protrusion that the unit contacts and can override being a convex part disposed upstream in the detachment direction of the unit, and the second protrusion disposed downstream in the detachment direction of the unit serves as the stopper;

the unit includes a projection that contacts the protrusions of the guide member;

a distance between the two protrusions is longer than a length of the projection of the unit; and the two protrusions each have a height that is greater than a height of the projection of the unit.

5. The retainer device as claimed in claim 4, wherein:

at least one of the first protrusion of the guide member upstream in the unit detachment direction and the projection of the unit downstream in the unit detachment direction is provided with a slanted surface angled with respect to the detachment direction of the unit; and at least one of the second protrusion of the guide member downstream in the unit detachment direction and the projection of the unit upstream in the unit detachment direction is provided with a slanted surface angled with respect to the detachment direction of the unit.

6. An image forming apparatus, comprising:

a unit detachably attached to the image forming apparatus;

a retainer device configured to prevent the unit from dropping when the unit is detached from the image forming apparatus and comprising:

a guide member disposed at a proximal side inside the apparatus to supportably guide the unit with respect to the image forming apparatus when the unit is detached from the image forming apparatus; and a stopper, disposed on the guide member, configured to contact the unit when the unit is moving in a direction separating from the image forming apparatus and stop the unit from dropping from the image forming apparatus; and a positioning device to position the unit relative to the apparatus, wherein the guide member is configured to be switchable between a first separation regulating state, in which the guide member regulates the unit by preventing the unit from detaching from the image forming apparatus, and a second guidable state, in which the guide member supports the unit, while guiding the unit, in the direction separating from the image forming apparatus when the unit is detached from the image forming apparatus, and wherein the positioning device is pressed by the guide member switched to the first separation regulating state, so that the unit is positioned by the positioning device relative to the image forming apparatus.

7. The image forming apparatus as claimed in claim 6, wherein:

the positioning device comprises:

a movable member that moves by being pressed by the guide member when the guide member is in the first separation regulating state; and an elastic member that is elastically deformed to press the unit in the attachment direction when the movable member is pressed by the guide member.

8. The image forming apparatus as claimed in claim 7, wherein:

the movable member includes a locking part configured to lock the guide member in the first separation regulating state.

9. The image forming apparatus as claimed in claim 6, wherein:

when the guide member is switched to the first separation regulating state, the unit moves to be positioned relative to the image forming apparatus by contact between the guide member and the unit.

10. The image forming apparatus as claimed in claim 6, further comprising an openably closable cover, wherein:

when the guide member is switched to the first separation regulating state, the guide member is configured to be outside a moving locus of the cover or a member disposed on the cover when the cover is opened or closed; and when the guide member is switched to the second guidable state, the guide member is configured to be on a moving locus of the cover or the member disposed on the cover when the cover is opened or closed.

11. The image forming apparatus as claimed in claim 10, wherein:

when the guide member is switched to the second guidable state and the cover is opened, the guide member is positioned higher than the member disposed on the cover.

12. The image forming apparatus as claimed in claim 10, wherein:

when the guide member is switched to the second guidable state, the guide member is positioned within a space in the image forming apparatus for installing the member disposed on the cover.

13. The image forming apparatus as claimed in claim 10, wherein:

the guide member can be switched from the second guidable state to the first separation regulating state by a contact of the cover or the member disposed on the cover with a contacted portion of the guide member.

14. The image forming apparatus as claimed in claim 13, wherein:

the member disposed on the cover is configured to be attachably detachable to and from the cover; and the guide member includes a guide portion that guides the member disposed on the cover to a direction mounting to the cover as the cover is being closed when the guide member is switched to the first separation regulating state.

15. The image forming apparatus as claimed in claim 14, wherein:

the cover or the member disposed on the cover includes a contact portion to contact the contacted portion of the guide member;

the member disposed on the cover guided by the guide portion includes a guided portion; and the contact portion is disposed downstream of the guided portion in a cover closing direction.

16. The image forming apparatus as claimed in claim 14, wherein:

a moving locus of the guide portion is configured to approach in a direction to close the cover with respect to a moving locus of the guided portion when the cover is closed.

17. The image forming apparatus as claimed in claim 6, further comprising:

an image carrier to carry a toner image thereon, wherein the unit is constructed as a transfer unit and is configured to transfer the toner image on the image carrier to a sheet of paper, wherein the unit further includes an intermediate transfer member configured to transfer the toner image transferred from the image carrier to the sheet of paper; and the intermediate transfer member is an endless intermediate belt stretched around a plurality of rollers.

18. The image forming apparatus as claimed in claim 6, further comprising:

an image carrier to carry a developer image on its surface thereof, wherein the unit is constructed as a transfer unit and is configured to transfer the developer image on the image carrier to a sheet of paper; and the transfer unit further comprises a conveyance member to transfer, while conveying the sheet of paper, the developer image on the image carrier to the sheet of paper, wherein the conveyance member is an endless conveyance belt stretched over a plurality of rollers.

19. An image forming apparatus, comprising:

a unit detachably attached to the image forming apparatus; and a guide member disposed at a proximal side inside the apparatus to supportably guide the unit with respect to the image forming apparatus when the unit is detached from the image forming apparatus, wherein the guide member is configured to rotate about an axis of rotation substantially parallel to a detachment direction of the unit to switch between a first separation regulating state in which the guide member regulates the unit by preventing the unit from detaching from the image forming apparatus, and a second guidable state, in which the guide member supports the unit, while guiding the unit, in the direction separating from the image forming apparatus when the unit is detached from the image forming apparatus.

* * * * *